US010989211B2

(12) United States Patent
Galeotti et al.

(10) Patent No.: US 10,989,211 B2
(45) Date of Patent: Apr. 27, 2021

(54) METHODS AND SYSTEMS FOR ANTISURGE CONTROL OF TURBO COMPRESSORS WITH SIDE STREAM

(71) Applicant: Nuovo Pignone Srl, Florence (IT)

(72) Inventors: Daniele Galeotti, Florence (IT); Antonio Pelagotti, Florence (IT); Gabriele Giovani, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 993 days.

(21) Appl. No.: 14/780,170

(22) PCT Filed: Mar. 24, 2014

(86) PCT No.: PCT/EP2014/055830

§ 371 (c)(1),
(2) Date: Sep. 25, 2015

(87) PCT Pub. No.: WO2014/154628

PCT Pub. Date: Oct. 2, 2014

(65) Prior Publication Data

US 2016/0040680 A1 Feb. 11, 2016

(30) Foreign Application Priority Data

Mar. 26, 2013 (IT) ..... FI2013A000063

(51) Int. Cl.
*F04D 27/02* (2006.01)
*F04D 17/12* (2006.01)
(Continued)

(52) U.S. Cl.
CPC ..... *F04D 27/02* (2013.01); *F04D 17/122* (2013.01); *F04D 19/02* (2013.01); *F04D 27/001* (2013.01); *F04D 27/0207* (2013.01)

(58) Field of Classification Search
CPC .. F04D 27/02; F04D 27/0207; F04D 27/0223; F04D 17/12; F04D 17/122; F04D 19/02; F05B 2270/1081
See application file for complete search history.

(56) References Cited

U.S. PATENT DOCUMENTS 4,156,578 A * 5/1979 Agar ..... F04D 27/001 415/1
4,288,198 A * 9/1981 Hibino ..... F04D 27/02 415/1
(Continued)

FOREIGN PATENT DOCUMENTS

CN 1836109 A 9/2006
CN 101876323 A 11/2010
(Continued)

OTHER PUBLICATIONS

English Machine Translation of DE 42 02 226 A1 go Grundmann et al., translated by Espacenet Dec. 17, 2020 (Year: 1991).*
(Continued)

*Primary Examiner* — David E Sosnowski
*Assistant Examiner* — Wayne A Lambert
(74) *Attorney, Agent, or Firm* — Baker Hughes Patent Organization

(57) ABSTRACT

A method is described for providing antisurge control in a system comprising a compressor having at least an upstream compressor stage, a downstream compressor stage and a side stream bringing flow into a flow passage between the upstream compressor stage and the downstream compressor stage. The method provides for estimating a temperature of a flow delivered by the upstream compressor stage using a non-dimensional performance map of the upstream compressor stage and further estimating a temperature of a flow entering the downstream compressor stage based on the mass flow and flow temperature of the flow delivered by the
(Continued)

downstream compressor stage and the mass flow and the flow temperature of the side stream. The method further provides for performing antisurge control of the downstream compressor stage based on the temperature of the flow entering the downstream compressor stage.

15 Claims, 5 Drawing Sheets

(51) Int. Cl.
*F04D 19/02* (2006.01)
*F04D 27/00* (2006.01)

(56) References Cited

U.S. PATENT DOCUMENTS

| | | | | |
|---|---|---|---|---|
| 4,807,150 | A * | 2/1989 | Hobbs | F04D 27/0207 137/100 |
| 4,825,380 | A | 4/1989 | Hobbs | |
| 4,949,276 | A | 8/1990 | Staroselsky et al. | |
| 5,290,142 | A * | 3/1994 | Ispas | F04D 27/0207 415/1 |
| 5,599,161 | A * | 2/1997 | Batson | F04D 27/02 415/17 |
| 6,503,048 | B1 | 1/2003 | Mirsky | |
| 7,094,019 | B1 * | 8/2006 | Shapiro | F04D 27/0284 415/17 |
| 7,096,669 | B2 * | 8/2006 | Narayanan | F04D 27/0207 415/1 |
| 9,074,606 | B1 * | 7/2015 | Moore | F04D 17/12 |
| 2005/0265822 | A1 | 12/2005 | Fledersbacher et al. | |
| 2007/0110587 | A1 | 5/2007 | Takeshita | |
| 2009/0317260 | A1 | 12/2009 | Mirsky et al. | |
| 2010/0272588 | A1 | 10/2010 | Scotti Del Greco et al. | |
| 2011/0229303 | A1 | 9/2011 | Winkes | |
| 2012/0048387 | A1 | 3/2012 | Galeotti | |
| 2014/0154051 | A1 * | 6/2014 | Di Febo | F04D 27/02 415/17 |
| 2014/0165583 | A1 * | 6/2014 | Oliverio | F02C 9/18 60/776 |

FOREIGN PATENT DOCUMENTS

| | | | | |
|---|---|---|---|---|
| CN | 102224346 | A | 10/2011 | |
| CN | 102392812 | A | 3/2012 | |
| CN | 102400903 | A | 4/2012 | |
| DE | 4202226 | A1 * | 4/1993 | F04D 27/0207 |
| EP | 1555438 | A2 | 7/2005 | |
| JP | S62-48999 | A | 3/1987 | |
| JP | H06-101500 | A | 4/1994 | |
| JP | 2000337109 | A | 12/2000 | |
| WO | 2004038229 | A1 | 5/2004 | |
| WO | 2012007553 | A1 | 1/2012 | |
| WO | WO-2015132196 | A1 * | 9/2015 | F04D 27/0269 |

OTHER PUBLICATIONS

Unofficial English Translation of Italian Search Report issued in connection with Related A Related IT Application No. CO2012A000056 dated Jul. 5, 2013.

PCT Search Report & Written Opinion issued in connection with Related PCT Application No. PCT/EP2013/073047 dated Dec. 9, 2013.

Unofficial English Translation of Chinese Office Action issued in connection with Related CN Application No. 201380058396.9 dated Apr. 25, 2016.

Unofficial English Translation of Chinese Office Action issued in connection with Corresponding CN Application No. 201480018356.6 dated May 5, 2016.

Australian Search Report issued in connection with Related AU Application No. 2013343647 dated Oct. 18, 2016.

Daniele, G., A method for operating a compressor in case of failure of one or more measure signal, GE Co-Pending Application No. CO2012A000056, filed Nov. 7, 2012.

Machine Translation and Copy of Notification of Reasons for Refusal issued in connection with corresponding JP Application No. 2016-504610 dated Jan. 30, 2018.

Unofficial English Translation of Italy Office Action issued in connection with corresponding IT Application No. FI2013A000063 dated Nov. 21, 2013.

PCT Search Report and Written Opinion issued in connection with corresponding PCT Application No. PCT/EP2014/055830 dated May 13, 2014.

* cited by examiner

METHODS AND SYSTEMS FOR ANTISURGE CONTROL OF TURBO COMPRESSORS WITH SIDE STREAM

BACKGROUND

The present disclosure relates to compressor systems and more particularly to turbo compressor systems including axial and/or centrifugal compressors for processing a gas flow. The subject matter of the present disclosure concerns methods and systems for controlling the compressor arrangement to prevent or reduce surge phenomena and other undesirable operating conditions.

DESCRIPTION OF THE RELATED ART

Turbo compressors are work-absorbing turbomachines used to boost the pressure of a working gaseous flow. The pressure of the working fluid is increased by adding kinetic energy to a continuous flow of working fluid through rotation of a rotor supporting one or more impellers and/or one or more sets of blades in circular arrangements. Turbo compressors are frequently used in pipeline transportation of natural gas, for example to move gas from a production site to a consumer location, in gas and oil applications, refrigeration systems, gas turbines, and other applications.

The flow of fluid through the turbo compressor can be affected by various conditions leading to unstable operations which can result in serious damages of the turbomachine.

Compressor surge occurs when the pressure of a working fluid flowing through the compressors increases beyond a maximum allowable output pressure and/or if the flow rate drops beyond a minimum limit.

In general a surge phenomenon occurs when the compressor cannot add enough energy to the working fluid in order to overcome the system resistance, i.e. the head drop across the system, a situation which results in a rapid flow and discharge pressure decrease. The surge may be accompanied by high vibrations, temperature increase and rapid changes in the axial thrust on the bearings of the compressor shaft. These phenomena can severely damage the compressor and also the components of the system connected to the compressor, such as valves and piping. To prevent surge phenomena to arise, control systems have been developed and are currently used in turbo compressor installations.

FIG. 1 illustrates a schematic system 1, comprised of a turbo compressor 3 driven into rotation by a prime mover 5, for example an electric motor, a gas or steam turbine, or the like. Reference number 7 indicates a suction line, where from the working fluid is fed to the suction or inlet side of the turbo compressor 3. Reference number 9 designates the delivery pipe, where through the compressed fluid is delivered from the discharge side of the compressor 3.

FIG. 2 schematically illustrates a compressor performance map, typically a compressor performance map of an axial compressor. The performance map shows the pressure ratio along the vertical axis and the volumetric inlet flow reported on the horizontal axis. The inlet flow is indicated with the letter Q. Depending upon the operating conditions of the compressor, for example the rotary speed (rpm), a plurality of expected performance curves can be reported in the performance map. Each curve can correspond to a different compressor rotary speed. For a given compressor setup, therefore, a family of performance curves can be reported on the performance map. Similar curve families can be drawn for different setup or operating conditions of the turbo compressor, e.g. for different positions of movable inlet guide vanes (IGVs), the turbo compressor can be provided with. Each performance curve ends at a surge point, i.e. a point where the pressure ratio and the gas flow through the compressor have achieved a value, beyond which surge phenomena will be generated. The line SLL is the so called Surge Limit Line, formed by the surge points of the various performance curves reported on the performance map. The SLL divides the performance map in two areas: a stable-operating area and a surge area. The stable-operating area is located under and on the right hand of the SLL. The operative point of the turbo compressor shall be maintained in the stable-operating area of the performance map to prevent surge phenomena to occur.

Since surge phenomena can result in serious damages to the turbomachine and connected mechanical components, in order to operate the system safely, a surge control line, labeled SCL, is drawn on the map. The SCL extends approximately parallel to the Surge Limit Line SLL in the stable-operating area. The SCL represents the limit of operation of the turbo compressor, beyond which the compressor shall not be operated to prevent the risk of surge phenomena. Known compressor systems are comprised of surge control devices and arrangements to control the turbo compressor so that it will constantly operate on the right side of the performance map, i.e. under the surge control line SCL.

In the diagrammatic representation of FIG. 1 a control unit 11 is connected to various instrumentalities surrounding the turbo compressor to determine the operating conditions of the turbomachine and provide antisurge control for preventing surge phenomena from arising.

More particularly, in the exemplary embodiment of FIG. 1, the control unit 11 is connected to a flow measuring device, also called flow element 13 that is designed and configured to determine the inlet volume flow rate of the turbo compressor 3. A temperature sensor at the inlet side provides a temperature value Ts and pressure sensors provide the delivery pressure value Pd and suction pressure value Ps or directly the compression ratio Pd/Ps.

Based on the input data the control unit 11 is capable of determining the inlet volume flow rate and the pressure ratio at each and every instant of operation of the turbo compressor 3. These two parameters define the operating point on the compressor performance map of FIG. 2. As additional parameter the rotary speed N (rpm) of the compressor can be provided, so that the correct operating curve can be selected to determine the actual position of the compressor operating point in the performance map. If the operating point approaches the surge control line SCL, the surge control system acts upon an antisurge bypass valve 15. The valve 15 is arranged on a bypass line 17 connecting the delivery side and the suction side of the compressor 3. A part of the working fluid delivered by the turbo compressor 3 can be recirculated through the antisurge valve 15, if required, to prevent surge phenomena. When the delivery pressure increases so that the operating point reaches the surge control line SCL, the antisurge control arrangement opens the antisurge bypass valve 15 so that the flow rate through the compressor can increase and the delivery pressure can decrease.

Before being recirculated through the antisurge valve 15 the working fluid can be cooled in a heat exchanger 19.

FIG. 3 illustrates a compressor arrangement including a side stream. The compressor 3 is comprised of a first compressor stage 3A and a second compressor stage 3B. A side stream 20 delivers a gas flow which is added to the flow delivered by the first compressor stage 3A to the second compressor stage 3B. A motor 5 drives the two compressor stages into rotation. A flow element 13 and a transducer FT1 are provided at the suction side of the compressor 3, to determine the volume flow rate. A temperature transducer T1*s* and a pressure transducer P1*s* measure the gas temperature and pressure at the suction side of the compressor. Similar transducers FTss, Tss and Pss determine the volume flow rate, temperature and pressure of the side stream. A pressure transducer Pd2 determines the delivery pressure of the compressor. To perform antisurge control of the second compressor stage 3B, the temperature conditions at the suction side thereof is estimated, based on the measurements carried by the above mentioned transducers, since no transducer can be arranged inside the machine to directly measure the suction side temperature.

An antisurge bypass line 17 with an antisurge bypass valve 15 is provided. The antisurge valve is opened when the operating point of the compressor approaches the surge limit line.

A method for estimating the suction side temperature of a second or subsequent compressor stage in a turbo compressor with side stream is disclosed in U.S. Pat. No. 6,503,048, which is incorporated herein by reference.

Known methods for estimating the suction side temperature of a downstream compressor stage are based on considerable simplifications, which result in a rather inaccurate estimation of the operating point of the compressor. This in turn results in inefficiency of the turbo compressor.

SUMMARY OF THE INVENTION

The subject matter disclosed herein concerns an improved method for providing antisurge control of a compressor system having at least an upstream compressor stage, a downstream compressor stage and a side stream bringing flow into a flow passage between the upstream compressor stage and the downstream compressor stage. The method comprises the step of estimating a temperature of a flow delivered by the upstream compressor stage using a non-dimensional performance map of the upstream compressor stage. Based on the estimate delivery temperature, a further step of estimating a temperature of a flow entering the downstream compressor stage is performed, based on the mass flow and flow temperature of the flow delivered by the downstream compressor stage and the mass flow and the flow temperature of the side stream. Antisurge control of the downstream compressor stage can then be performed, based on the temperature of the flow entering the downstream compressor stage.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
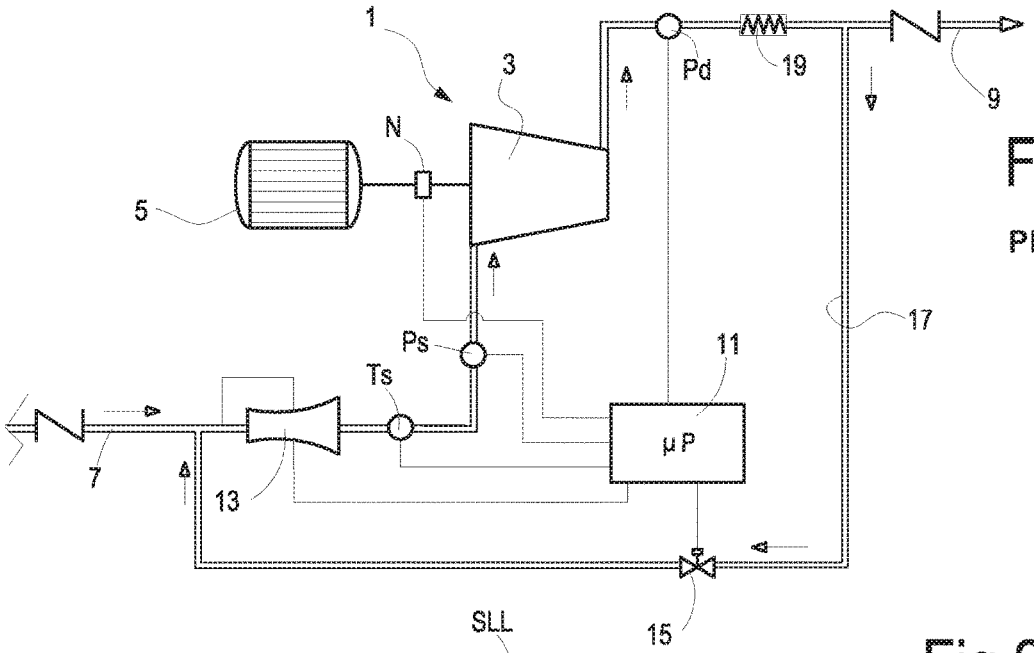
Fig.1 PRIOR ART
FIG. 1 illustrates a compressor arrangement with antisurge control according to the current art.
Figure 2:
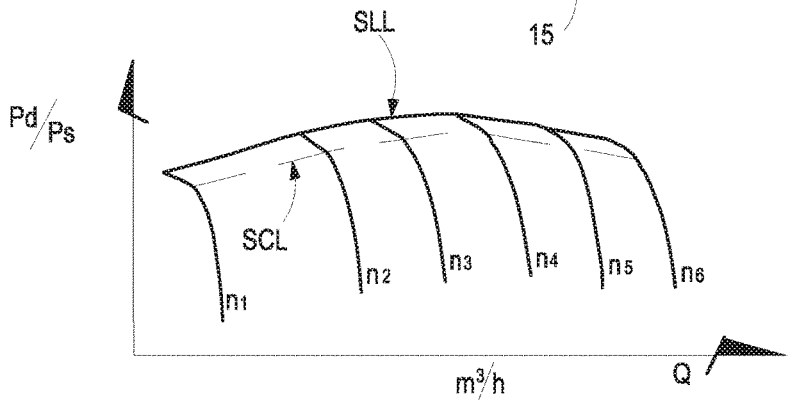
Fig.2 PRIOR ART
FIG. 2 illustrates a performance map of a turbo compressor.
Figure 3:
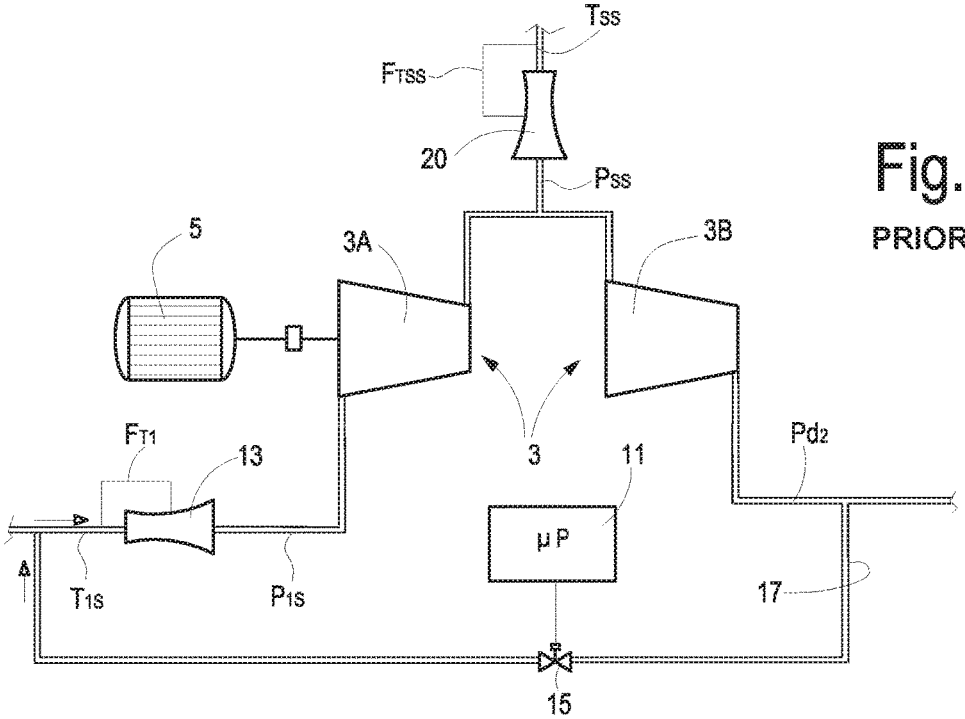
Fig.3 PRIOR ART
FIG. 3 illustrates an antisurge control arrangement in a compressor system comprising a side stream.
Figure 4:
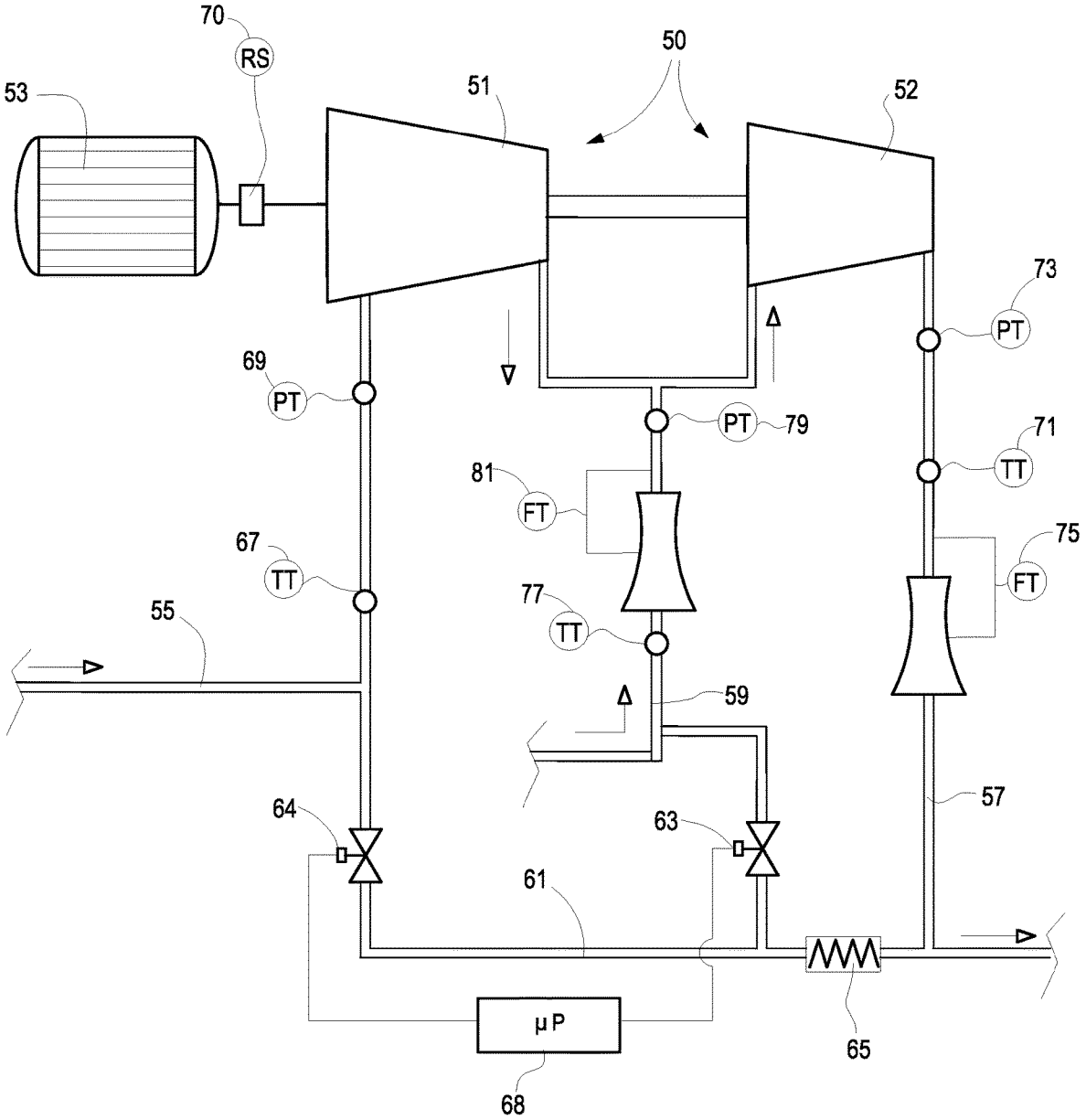
FIG. 4 illustrates a compressor arrangement with side stream and antisurge control according to the subject matter disclosed herein.

FIG. 4 schematically shows a turbo compressor 50 comprising two compressor stages 51 and 52. The two stages are represented as separate bodies, but can be housed in a common casing. A prime mover, such as a gas turbine, an electric motor or the like, is shown at 53 and drives the compressor into rotation. Process gas is delivered at the inlet of the turbo compressor 50 through an inlet line schematically shown at 55. A compressed gas delivery line is shown at 57. A side stream line 59 delivers a side stream to the inlet or suction side of the second compressor stage 52. The side stream is mixed with the gas stream delivered at the outlet side of the first compressor stage 51.

In some embodiments, a bypass line 61 is provided between the delivery side of the turbo compressor 50, i.e. the delivery of the second compressor stage 52, and the inlet or suction side of the turbo compressor first compressor stage 51, as well as between the delivery side of the second compressor stage 52 and the side stream inlet. A first antisurge valve 63 can be arranged between the bypass line 61 and the side stream inlet. A second antisurge valve 64 can be provided between the bypass line 61 and the suction of the compressor 50. A heat exchanger 65 can be provided to remove heat from the compressed gas before recirculating the gas through the bypass line 61. The antisurge valves 63 and 64 can be controlled by an antisurge controller 68, based on a known antisurge algorithm.

In some embodiments, at the suction side of the turbo compressor 50 a temperature transducer 67 and a pressure transducer 69 are provided, to measure the temperature and the pressure of the gas at the suction side of turbo compressor 50. The measured temperature and pressure values at the suction side of the first compressor stage 51 are indicated with T1*s* and P1*s*, respectively, where 1 indicates the stage number and "s" stays for "suction". A rotary speed detector 70 is also provided, to determine the rotary speed of the compressor.

Similarly, a temperature transducer 71 and a pressure transducer 73 can be arranged at the delivery side of the second compressor stage 52, to measure the temperature T2*d* and the pressure P2*d* at the delivery side of the second compressor stage. A flow measuring device, or flow element 75 is provided at the delivery side of the turbo compressor to measure the volume flow rate of the compressed gas delivered by the turbo compressor 50. As will be explained later on, the volume flow rate at the inlet of the compressor 50 can be calculated based on the physical parameters measured by the above described transducers and elements. In other embodiments, a flow measuring device can be provided at the inlet of the compressor 50 rather than at the delivery side thereof. However, arranging the flow element at the compressor delivery side results in a simpler, more compact and accurate arrangement since the volume of the gas flow is reduced due to the compression ratio of the compressor.

Transducers can be provided also along the side stream line 59. A temperature transducer 77, a pressure transducer 79 and a flow measuring device 81 are provided to detect the temperature T2*ss*, the pressure P2*ss* and the volume flow rate at the side stream inlet of the second compressor stage 52.

The following definitions and relationships are useful in understanding the method of controlling the turbo compressor disclosed herein.

As well known, the gas density is given by $$\rho = \frac{PMw}{RTZ} \tag{1}$$

where
R=8.3143 kJ/kmol K is the gas constant
P is the pressure
Mw is the molecular weight of the gas
T is the temperature
Z is the compressibility of the gas, which depends upon the gas composition and the gas conditions (temperature and pressure).

The speed of sound in a gas is given by $$a = \sqrt{k_v \frac{ZRT}{Mw}} \tag{2}$$

where
$k_v$ is the isoentropic volume exponent
Z, R, T, Mw are as defined above.

The volume flow is determined in a flow measuring device, e.g. an orifice or a Venturi tube based on the following relationship $$Q = k_{FE}\sqrt{\frac{h}{\rho}} \tag{3}$$

where
$k_{FE}$ is a constant
h is the pressure drop across the flow measuring element
ρ is the gas density.

The mass flow is given by $$G = Q\rho = k_{FE}\sqrt{h\rho} \tag{4}$$

The polytropic head across a compressor stage is given by $$Hp = \frac{ZRT}{Mw}\left[\frac{P_{ratio}^{\left(\frac{n-1}{n}\right)} - 1}{\left(\frac{n-1}{n}\right)}\right] = \frac{ZRT}{Mw}hr \tag{5}$$

where
n is the polytropic volume exponent
$P_{ratio}$ is the pressure ratio across the compressor stage
hr is the reduced polytropic head defined as $$hr = \left[\frac{P_{ratio}^{\left(\frac{n-1}{n}\right)} - 1}{\left(\frac{n-1}{n}\right)}\right] \tag{6}$$

The relationship between gas pressure and gas density at the suction and delivery side of the compressor or compressor stage, and polytropic volume exponent is given by $$P_d = P_s\left(\frac{\rho_d}{\rho_s}\right)^n \tag{7}$$

where
$P_s$ is the gas pressure at the suction side of the compressor stage
$P_d$ is the gas pressure at the delivery side of the compressor stage
$\rho_s$ is the gas density at the suction side of the compressor stage
$\rho_d$ is the gas density at the delivery side of the compressor stage The relationship between temperature at the delivery side and at the suction side of the compressor stage is as follows:

$$T_d = T_s\left(\frac{P_d}{P_s}\right)^m = T_s(P_{ratio})^m \quad (8)$$

where

Ts is the gas temperature at the suction side of the compressor stage

Td is the gas temperature at the delivery side of the compressor stage m is the polytropic temperature exponent.

The head across the compressor stage is given by $$H = \frac{Hp}{\eta_p} \quad (9)$$

where $\eta_p$ is the polytropic efficiency of the compressor stage

Figure 5:
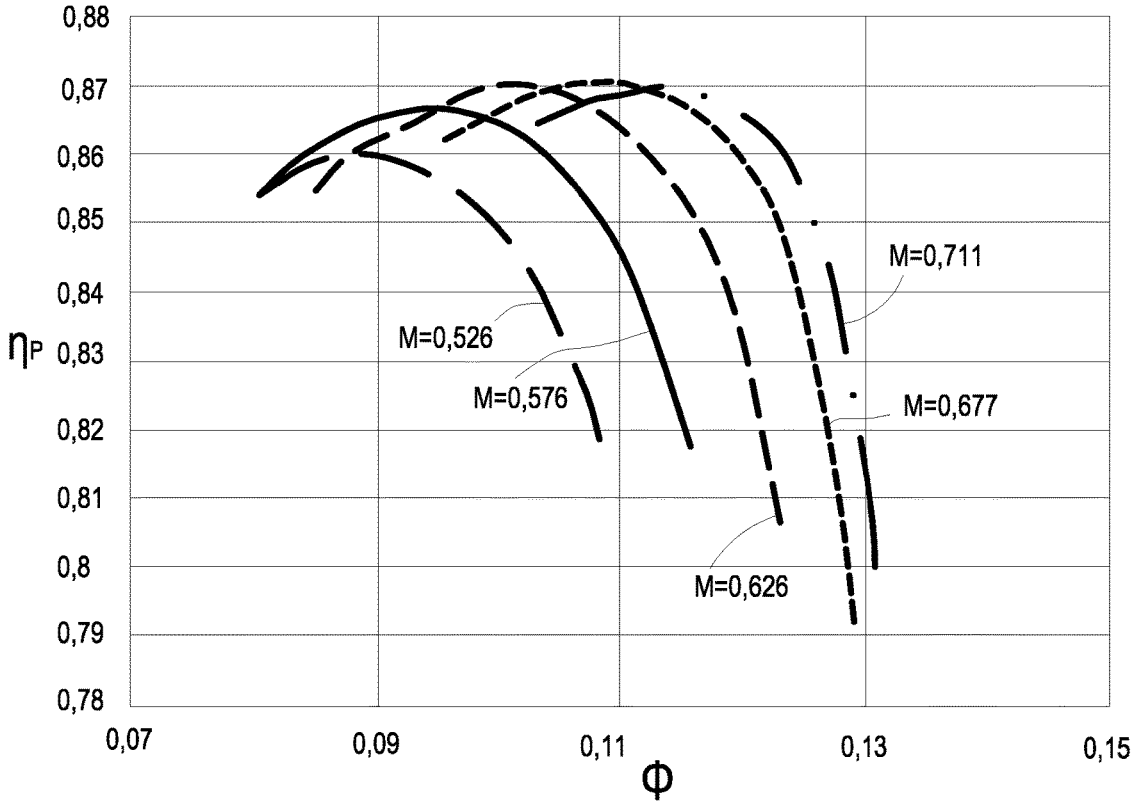
FIG. 5 illustrates a non-dimensional performance map.

The control method of the subject matter disclosed herein uses a compressor performance map which is independent of the gas parameters at the inlet of the compressor stage. A suitable non-dimensional performance map is shown in FIG. 5. The map shows a family of performance curves representing the dimensionless polytropic efficiency versus the dimensionless gas flow across the compressor stage, defined as $$\Phi = \frac{4Q}{\pi D^2 u} \quad (10)$$

where

D is the diameter at the impeller tip or blade tip of the compressor

Q is the volume flow rate u is the impeller tip or blade tip speed given by $$u = \frac{ND\pi}{60} \quad (11)$$

where N is the rotary speed of the compressor in rpm. The Mach number is given by $$M = \frac{u}{a} \quad (12)$$

where (a) is the speed of sound, given by formula (2). Each curve corresponds to a different Mach number.

The dimensionless performance map of FIG. 5 is obtained analytically starting from impellers models and it can be refined during a test phase, using suitable sensors arranged inside the machine. These sensors will be removed once the turbomachine is installed and ready to operate. When the machine is operating, the actual operating point of the compressor on the performance map can be determined based on measurements on the compressor flow parameters and the polytropic efficiency can be obtained by the performance map.

The polytropic efficiency is used to calculate the polytropic temperature exponent and determine the gas temperature in locations of the compressor, which are not accessible for temperature measurement during normal operation of the compressor.

Having now defined the main physical parameters used, the control method of the present disclosure will now be described in greater detail in the case of a two-stage turbo compressor with side stream depicted in FIG. 4.

The flow measuring device 75, the temperature transducer 71 and the pressure transducer 73 at the delivery side of the second compressor stage 52 provide data for measuring the volume flow and mass flow of the second compressor stage 51 using formula (3) and (4), through the datasheet of the flow measuring element and the interpolated gas properties at the measured pressure and temperature conditions, to determine the compressibility Z and the density p, respectively.

Similarly, the flow measuring device or flow element 81, the pressure transducer 79 and the temperature transducer 77 on the side stream line 59 provide the required data to calculate the volume flow and mass flow of the side stream. Once the mass flow of the side stream ($G_{2ss}$) and the mass flow delivered by the compressor 50 ($G_{2d}$) are known, the inlet mass flow at the suction side of the first compressor stage is determined by difference as $$G_{1s}=G_{2d}-G_{2ss} \quad (13)$$

where $G_{2s}$ is the mass flow at the delivery side of the second stage 52 of the turbo compressor $G_{2ss}$ is the side stream mass flow.

From the mass flow across the first compressor stage 51 the volume flow at the inlet of the compressor can be calculated using formula (4). The temperature and pressure of the gas are known from transducers 67 and 69, so that the gas density can be calculated using formula (1) based on the interpolated gas properties at the measured pressure and temperature conditions.

In a different embodiment, not shown, a flow measuring device can be provided at the inlet of the compressor 50, so that the inlet volume flow of the first stage 51 can be calculated directly. Providing the flow measuring device at the delivery side is, however, preferable, for the reasons mentioned above.

Using formula (10) the non-dimensional gas flow (Φ) at the inlet side of the first compressor stage 51 is determined. Using formula (2) the speed of sound at the suction side of the first compressor stage 51 is calculated and the Mach number (M) is obtained from formula (12). Based on the two parameters (Φ) and (M), the polytropic efficiency $\eta_p$ is determined using the performance map of FIG. 5, which can be stored in a suitable form in a storage memory.

Once the polytropic efficiency $\eta_p$ is determined, the polytropic temperature exponent (m) of formula (8) is then determined as $$m = \frac{(kT-1)}{kT} * \left(X + \frac{1}{\eta_P}\right) * \frac{1}{1+X} \quad (14)$$

where the polytropic efficiency $\eta_p$ is obtained by the non-dimensional performance map of FIG. 5 as described above, and the parameters kT (iso-entropic exponent in T) and X (compressibility function) depend upon the nature of the gas and upon the temperature and pressure conditions thereof, and are defined as follows:

$$\left[\frac{P^{\frac{kT-1}{kT}}}{T}\right]_s = const \quad (14A)$$

-continued $$X = \frac{T}{V}\left(\frac{\partial V}{\partial T}\right)_P - 1 \tag{14B}$$

The gas temperature $T_{1d}$ at the delivery of the first compressor stage 51 is then determined using formula (8) as follows $$T_{1d} = T_{1s}\left(\frac{P_{1d}}{P_{1s}}\right)^m = T_{1s}\left(\frac{P_{2ss}}{P_{1s}}\right)^m \tag{15}$$

as the delivery pressure $P_{1d}$ of the first compressor stage 51 corresponds to the pressure $P_{2ss}$ of the side stream, which is measured by the pressure transducer 79.

Once the mass flow through the first compressor stage and the side stream mass flow, as well as the gas temperature of the side stream ($T_{2ss}$) and the gas temperature ($T_{1d}$) at the first stage delivery are known, the gas temperature at the suction of the second compressor stage 52 can be determined by mixing the mass flow $G_{1d}$ delivered by the first compressor stage 51 and the mass flow $G_{2ss}$ entering from the side stream line 59 as follows:

$$T_{2s} = \frac{T_{1d}G_{1d} + T_{2ss}G_{2ss}}{G_{1d} + G_{2ss}} \tag{16}$$

where $G_{1d}=G_{1s}$.

The pressure and temperature conditions at the inlet of the second compressor stage 52 are thus known and can be used to perform a known antisurge algorithm.

In some embodiments, the antisurge algorithm determines the operating point of the compressor in a performance map where one of the parameters is given by or is a function of the volume flow rate at the suction side of the compressor. Since the volume flow rate at the suction of the second compressor stage 52 is not known, an equivalent parameter is calculated, based on the parameters at the delivery side of the stage in an embodiment. Since the mass flow rate at the suction side and at the delivery side of the compressor stage are identical, the following equivalent head can be determined $$h_{2s_eq} = h_{2d}\frac{P_{2d}}{P_{2s}}\frac{T_{2s}}{T_{2d}}\frac{Z_{2s}}{Z_{2d}} \tag{16}$$

which is obtained from equations (1) and (4) and where $P_{2d}$, $P_{2s}$ are the gas pressure at the delivery side and suction side of the second compressor stage, respectively, and are measured by the pressure transducers, the suction side pressure being the same as the side stream pressure P2*ss;*

$T_{2d}$, $T_{2s}$ are the gas temperature at the delivery side and suction side of the second compressor stage respectively, the first temperature value being measured by the temperature transducer and the second temperature value being estimated based on equation (16);

$Z_{2d}$, $Z_{2s}$ are the compressibility of the gas at the delivery side conditions and suction side conditions of the second compressor stage, respectively. These two parameters can be calculated from a stored library, the gas conditions at the suction side and delivery side of the second compressor stage having been determined as described above.

In a simplified embodiment the compressibility can be assumed to be constant and deleted from equation (16).

Figure 6:
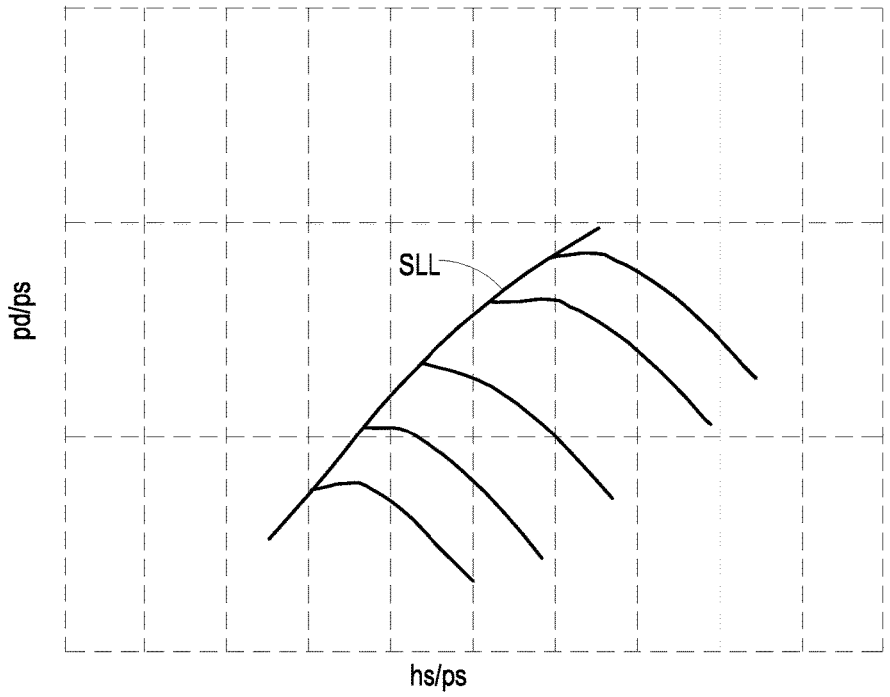
FIG. 6 illustrates a further performance map

The parameter $h_{2s_eq}$ can be used to determine the operating point of the second compressor stage 52 in a performance map e.g. as shown in FIG. 6. The curve SLL is the surge limit line and the curve SCL is the surge control line. The operating point of the compressor, which is determined based on the above described algorithm, is maintained in the stability area of the map, under the surge control line SCL.

Figure 7:
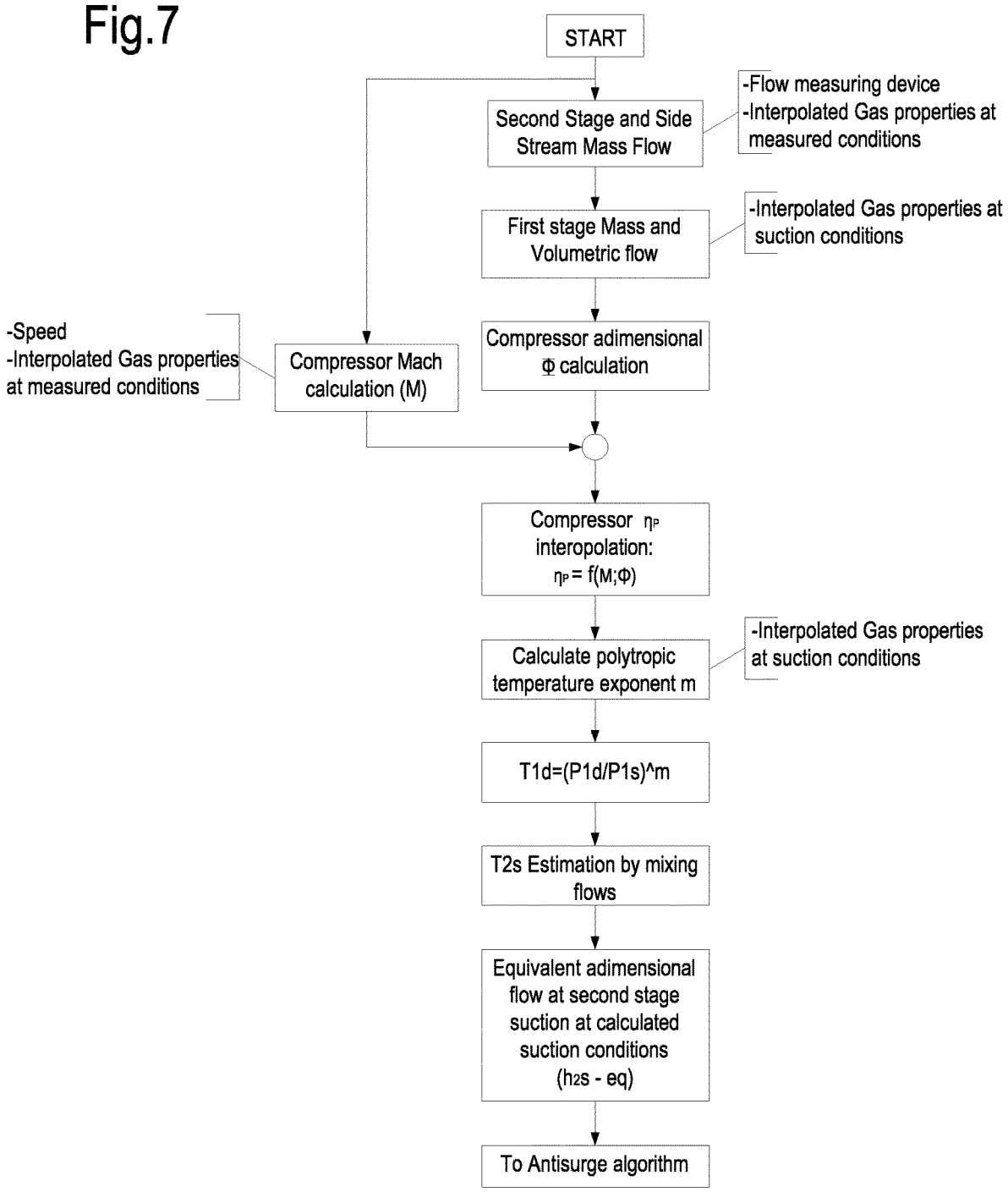
FIG. 7 illustrates a flow diagram of the control algorithm of the control method of the present disclosure.

The control method described so far is summarized in the flow chart of FIG. 7. Once the operating point on the performance map of the second compressor stage has been determined, an antisurge control system can be used to open the antisurge bypass valve 63 if the operating point of the second compressor stage 52 approaches the surge control line SCL, so as to bring the compressor back in the stability area of the performance map.

Figure 8:
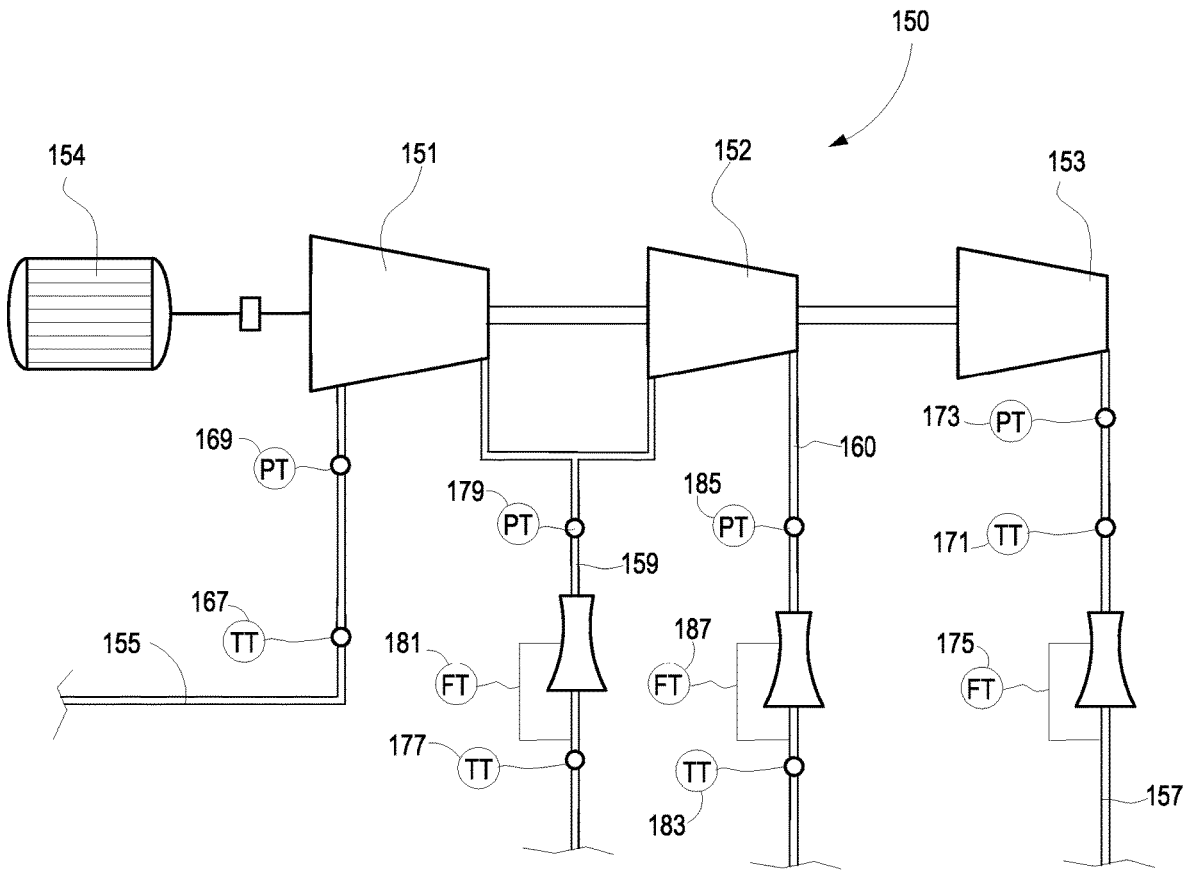
FIG. 8 illustrates a further diagram of a compressor arrangement with side stream and antisurge control according to the subject matter disclosed herein.

The above summarized method can be repeated for a turbo compressor having more than two compressor stages and respective side stream lines. FIG. 8 schematically shows a three-stage turbo compressor with two side stream lines. The turbo compressor is labeled 150 and is comprised of a first compressor stage 151, a second compressor stage 152 and a third compressor stage 153. A prime mover 154 drives the three stages into rotation. Reference number 155 indicates the delivery line, delivering the gas to the inlet of the first compressor stage 151. The compressed gas is delivered from the last compressor stage 153 along a delivery line 157. Side stream lines 159, 160 are further provided, where along respective side streams are delivered to the inlet of the second compressor stage 152 and of the third compressor stage 153, respectively.

A temperature transducer 167 and a pressure transducer 169 measure the temperature and pressure of the gas at the suction side of the first compressor stage 151. Respective temperature transducer 171 and pressure transducer 173 measure the temperature and pressure at the delivery of the third and last compressor stage 153. A flow measuring device or flow element 175 measures the volume flow rate on the delivery line 157. A temperature transducer 177, a pressure transducer 179 and a flow measuring device 181 arranged on the first side stream line 159, to measure the gas pressure and temperature conditions as well as the volume flow rate on the first side stream line 159. A similar arrangement comprising a temperature transducer 183, a pressure transducer 185 and a flow measuring device 187 is provided on the second side stream line 160.

The above described calculation method is used repeatedly in the turbo compressor 150 to determine the gas conditions at the suction side of the second and third compressor stage 152 and 153. Firstly, the mass and volumetric flow at the inlet of first stage 151 are determined, based on the values detected by the transducers at the inlet side of the first compressor stage 151 and at the delivery side of the last compressor stage 153. Subsequently, based on the mass and volumetric flow and on the side stream data (transducers 179, 177, 181), the temperature at the delivery of the first compressor stage 151 and the temperature at the inlet of the second compressor stage 152 are estimated. These data are used to perform similar calculations thus estimating the delivery temperature of compressor stage 152 and the suction temperature of the third compressor stage 153, based on the data of the second side stream, determined by transducers 183, 185, 187.

The same process can be used to estimate the temperature at the inlet side of any one of a plurality of compressor stages. Each time the process is executed, calculations will be performed based on the data of an upstream compressor stage, a downstream compressor stage and a side stream line, bringing flow into the flow passage from the upstream compressor stage to the downstream compressor stage.

In general terms, the volumetric and mass flow at the inlet of the first compressor stage can be determined based on a volume flow measurement performed downstream of the last compressor stage (stage 153 in the embodiment of FIG. 8, for example). In alternative embodiments, a flow measuring device or flow element can be arranged upstream of the first one of a plurality of sequentially arranged compressor stages, so that the volume flow and mass flow at the inlet of the compressor can be measured and calculated directly.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A method for providing antisurge control of a compressor system having at least an upstream compressor stage, a downstream compressor stage and a side stream bringing flow into a flow passage between the upstream compressor stage and the downstream compressor stage, the method comprising:

measuring by a flow measurement device positioned at a delivery side of the downstream compressor stage, a volume flow rate of the flow delivered by the downstream compressor stage;

estimating a temperature of a flow delivered by the upstream compressor stage using a non-dimensional performance map of said upstream compressor stage, wherein the non-dimensional performance map provides a polytropic efficiency of the upstream compressor stage as a function of a Mach number and a non-dimensional flow through the upstream compressor stage, and wherein the non-dimensional flow is determined from the measured volume flow rate of the flow delivered by the downstream compressor stage;

estimating a temperature of a flow entering the downstream compressor stage based on the mass flow and flow temperature of the flow delivered by the upstream compressor stage and the mass flow and the flow temperature of the side stream; and performing antisurge control of the downstream compressor stage based on the temperature of the flow entering the downstream compressor stage.

2. The method of claim 1, wherein the non-dimensional flow is defined as:

$$\Phi = \frac{4Q}{\pi D^2 u}$$

where

D is a diameter at the impeller tip or blade tip at the inlet of the upstream compressor stage and Q is a volume flow rate at the inlet of the upstream compressor stage and u is the impeller tip or blade tip speed.

3. The method of claim 1, wherein the temperature of the flow delivered by the upstream compressor stage is estimated based on a polytropic efficiency of the upstream compressor stage.

4. The method of claim 3, comprising the steps of:

determining the polytropic efficiency of the upstream compressor stage at operating conditions of the upstream compressor stage;

determining a polytropic temperature exponent based on pressure and temperature conditions of the gas and on the polytropic efficiency; and estimating the temperature of the flow delivered by the upstream compressor stage based on the polytropic temperature exponent.

5. The method of claim 4, wherein the polytropic temperature exponent is determined as:

$$m = \frac{(kT-1)}{kT} * \left(X + \frac{1}{\eta_P}\right) * \frac{1}{1+X}.$$

6. The method of claim 4, wherein the temperature of the flow delivered by the upstream compressor stage is calculated as $$T_{1d} = T_{1s}\left(\frac{P_{2ss}}{P_{1ss}}\right)^m$$

wherein $T_{1s}$ is the temperature at the suction side of the upstream compressor stage and $P_{2ss}$ is the pressure of the side stream and $P_{1s}$ is the pressure at the suction side of the upstream compressor stage.

7. The method of claim 1, wherein the temperature of the flow entering the downstream compressor stage is used to determine a location of an operating point of the downstream compressor stage compared to the surge limit thereof.

8. The method of claim 1, wherein the temperature of the flow entering the downstream compressor stage is used to calculate an equivalent head at the suction side of the downstream compressor stage, and wherein the equivalent head is used to perform antisurge control of the downstream compressor stage.

9. The method of claim 8, wherein the equivalent head is used to determine a location of an operating point of the downstream compressor stage compared to the surge limit thereof.

10. The method of claim 8, wherein the equivalent head is calculated as a function of a head at the delivery of the downstream compressor stage and of the flow pressure at the suction side and delivery side of the downstream compressor stage.

11. The method of claim 8, wherein the equivalent head is calculated as a function of a head at the delivery of the downstream compressor stage, of the flow pressure at the suction side and delivery side of the downstream compressor stage, and of the compressibility of the gas at the delivery and suction side of the downstream compressor stage.

12. The method of claim 8, wherein a flow rate at the suction side of the upstream compressor stage is determined by the pressure and temperature at the suction side of the upstream compressor stage and by the flow rate detected at the delivery side of the downstream compressor stage.

13. A system comprising: a compressor having at least an upstream compressor stage, a downstream compressor stage and a side stream bringing flow into a flow passage between the upstream compressor stage and the downstream compressor stage; and an antisurge arrangement; wherein said antisurge arrangement is configured for performing a method according to claim 1.

14. A system comprising:

a compressor having at least an upstream compressor stage, a downstream compressor stage, a side stream bringing flow into a flow passage between the upstream compressor stage and the downstream compressor stage and a flow measurement device positioned at a delivery side of the downstream compressor stage;

an antisurge arrangement; and a controller configured to estimate a temperature of a flow delivered by the upstream compressor stage using a non-dimensional performance map of said upstream compressor stage, estimate a temperature of a flow entering the downstream compressor stage based on the mass flow and flow temperature of the flow delivered by the upstream compressor stage and the mass flow and the flow temperature of the side stream, and control the antisurge arrangement to perform antisurge control of the downstream compressor stage based on the temperature of the flow entering the downstream compressor stage.

15. The system of claim 14, wherein the controller is configured to determine the non-dimensional flow from measurement of a volume flow rate of the flow delivered by the downstream compressor stage by the flow measurement device.

* * * * *